US005816369A

United States Patent [19]

Skalski

[11] Patent Number: 5,816,369

[45] Date of Patent: Oct. 6, 1998

[54] METHOD OF MOUNTING AN ELEVATOR ROLLER GUIDE ON A GUIDE RAIL

[75] Inventor: Clement A. Skalski, Avon, Conn.

[73] Assignee: Otis Elevator Company, Farmington, Conn.

[21] Appl. No.: 805,873

[22] Filed: Apr. 15, 1997

[51] Int. Cl.[6] ..... B66B 7/04

[52] U.S. Cl. ..... 187/410; 187/414

[58] Field of Search ..... 187/410, 409, 187/406, 414, 391, 397

[56] References Cited

U.S. PATENT DOCUMENTS

| | | | |
|---|---|---|---|
| 4,754,849 | 7/1988 | Ando | 187/95 |
| 5,117,946 | 6/1992 | Traktovenko et al. | 187/95 |
| 5,373,123 | 12/1994 | Skalski | 187/393 |
| 5,617,023 | 4/1997 | Skalski | 324/207.17 |

FOREIGN PATENT DOCUMENTS

| | | | |
|---|---|---|---|
| 467673 | 1/1992 | European Pat. Off. . | |
| 2262932 | 7/1993 | United Kingdom | 187/410 |

*Primary Examiner*—Kenneth Noland

[57] ABSTRACT

A method of installing roller guides in an elevator system so as to be centered on their respective T-rails. In the case of an elevator using either and active or semi-active roller guide system, the method uses the position transducers that are part of the roller guide to indicate how to reposition the roller guide after it is loosely bolted and approximately positioned on the elevator car. For an elevator not using an active roller guide or semi-active roller guide, the present invention temporarily attaches position transducers to the roller guide before bolting the roller guide to the elevator car. These position transducers are removed after centering the roller guide on the T-rail.

4 Claims, 5 Drawing Sheets

METHOD OF MOUNTING AN ELEVATOR ROLLER GUIDE ON A GUIDE RAIL

BACKGROUND OF THE INVENTION

1. Technical Field

The present invention pertains to the field of roller guides used in elevators. More particularly, the present invention pertains to a method of installing a roller guide so that it is properly aligned with respect to a T-rail in the elevator hoistway.

2. Description of Related Art

The installation of a roller guide on a T-rail has always been complicated by not being able to directly observe the progress of centering the roller guide with respect to the T-rail. A roller guide is installed by first approximately positioning it beneath an elevator car; next precisely positioning it so that it is centered, in a front-to-back sense, about the nose of a T-rail; and then bolting it to the elevator car. The roller guide, which often weighs from 50 to 60 pounds and can sometimes weigh over 150 pounds, is difficult to maneuver, and especially difficult to maneuver manually, with any precision.

A roller guide has rollers mounted beneath a metal plate. The metal plate is bolted to the elevator car once the roller guide is centered. The metal plate has a notch midway between the rollers. The roller guide must be mounted to the elevator so that the nose of the T-rail protrudes into the notch, midway from the two opposing sides of the notch. This notch or cut-out in the metal plate is here called the roller guide throat.

All elevator systems that use either active or semi-active roller guide systems have position transducers, for each roller guide, that sense in normal operation how far off-center of the T-rail nose the elevator is riding. An active roller guide system controls both this off-center position, in the directions from front-to-back of the elevator cab, as well as vibration in these same directions. A semi-active roller guide system controls only the off-center position, not the vibration. A passive roller guide system has roller guides, but does not have position transducers.

In all of these kinds of elevators, the roller guide must be positioned so that the nose of the T-rail on which the roller-guide is being positioned ends up in the middle of the roller guide's throat. This positioning must be done precisely for optimum performance of the elevator system, in terms of both everyday passenger comfort, and also wear of the elevator system. What is needed is a way to overcome the difficulty of not being able to observe directly the centering, and to enable precise monitoring of the progress toward proper alignment.

SUMMARY OF THE INVENTION

The present invention is a method that uses at least one position transducer to aid in positioning a roller guide on the nose of the T-rail so that the roller guide is centered, in a front-to-back sense. In many elevator systems, a roller guide is bolted to a safety, which in turn is bolted to the elevator frame. Both the safety and the roller guide have an integral metal plate with a notch, defining, in each case, what is here called a throat. During installation, both the safety throat and the roller guide throat must be carefully centered on the nose of a T-rail. Sometimes a roller guide is not to be mounted adjacent a safety. The present invention also applies to these non-safety-adjacent roller guides, even though in centering these roller guides, visibility is less restricted.

The method of the present invention is generally intended to be used along with some method of centering a safety, and, in the preferred embodiment, calls for centering a roller guide after its associated safety is centered and bolted to the elevator. Thus, this method results in aligning the throat of the roller guide with the safety throat, the safety throat having been aligned with respect to the nose of the T-rail.

In one embodiment of the present invention, a method for centering an elevator roller guide on a T-rail, in a front-to-back sense, where the T-rail has a nose that protrudes in normal operation into a throat of the roller guide and between rollers of the roller guide, and where the T-rail extends on either side of a hoistway along which the elevator moves, comprises the step of processing output of one or more position transducers, each affixed to the roller guide and oriented so as to sense the nose of the T-rail when the roller guide is positioned on the T-rail for normal operation, the processing of each output being performed by a position sensor to indicate how far the T-rail nose is from midway between opposing sides of the roller guide throat, and by comparison with a reference value, to indicate in which direction to move the roller guide to more accurately center it with respect to the nose of the T-rail.

Also according to the present invention for centering a roller guide, if the roller guide is part of a roller guide system including a front-to-back (f/b) controller that controls the position of the elevator with respect to a T-rail nose, the one or more position transducers are those that are part of the roller guide system, and the position sensor is part of the front-to-back controller.

In one aspect of the present invention, roller guides that are part of an active or semi-active roller guide system and that are to be mounted adjacent a safety are installed according to a procedure that is performed in part at the factory, and in part at the installation site. At the factory, a technician performs the following steps of the installation procedure:

For each roller guide, mount the roller guide on a T-rail and pre-set its one or more position transducers to provide a reference signal when the roller is centered on the T-rail, as indicated by the same monitoring equipment as will be used at the installation site. This monitoring equipment may include a voltmeter and position sensor module.

Alternatively, in case of using two position transducers, it is often convenient to choose the reference signal to have an indicated value of zero; then a positive or negative value of the signal from the position transducers will indicate in which direction the roller guide is off-center.

Next, optionally, for each roller guide, calibrate the one or more position transducers and monitoring equipment so as to equate the signal indicated by the monitoring equipment with distance and direction to move the roller guide to achieve centering.

At the installation site, a technician performs the rest of the procedure, including the following steps:

For each of the two safeties of the elevator car, one to go on each side, mount a corresponding safety alignment fixture on the T-rail.

Mount a safety oil each safety alignment fixture so that it is thereby centered, in a front-to-back sense, on the nose of its T-rail.

Bolt the safeties to the elevator car, thereby centering the elevator car, in a front-to-back sense, relative to its respective T-rail.

Block the elevator car on the safeties, so that the safeties remain centered, in a front-to-back sense, with respect to their respective T-rails.

For each roller guide to be positioned on a T-rail:

Take a roller guide not yet attached to the elevator car, and position it by hand so that it is approximately centered, in a front-to-back sense, on its T-rail, and bolt it loosely in place.

Configure the elevator f/b controller for each roller guide so that when power is provided, no force commands are output.

Attach a lead of a voltmeter to the position sensor of the elevator f/b controller, and attach the other lead to ground, or some common reference.

Position the roller guide, relative to the T-rail on which it is to be centered, to zero the reading indicated by the voltmeter, keeping the roller guide approximately level, shimming as necessary to account for being too far out of plumb. In other words, when positioning the roller guide to bolt its throated metal plate to the bottom of a safety, orient or shim the roller guide so that a plumb line is approximately normal to the metal plate. Since the T-rail is installed to be plumb, this plumbing of the roller guide will result in a perpendicular to its throated metal plate extending parallel to the T-rail.

Attach, by bolting for example, the roller guide to the safety, and thus to the elevator car.

Remove the safety alignment fixtures.

Reconfigure for normal operation all elevator f/b controllers.

BRIEF DESCRIPTION OF THE DRAWINGS

The above and other objects, features and advantages of the invention will become apparent from the consideration of the subsequent detailed description presented in connection with the accompanying drawings, in which.

DETAILED DESCRIPTION

Figure 1:
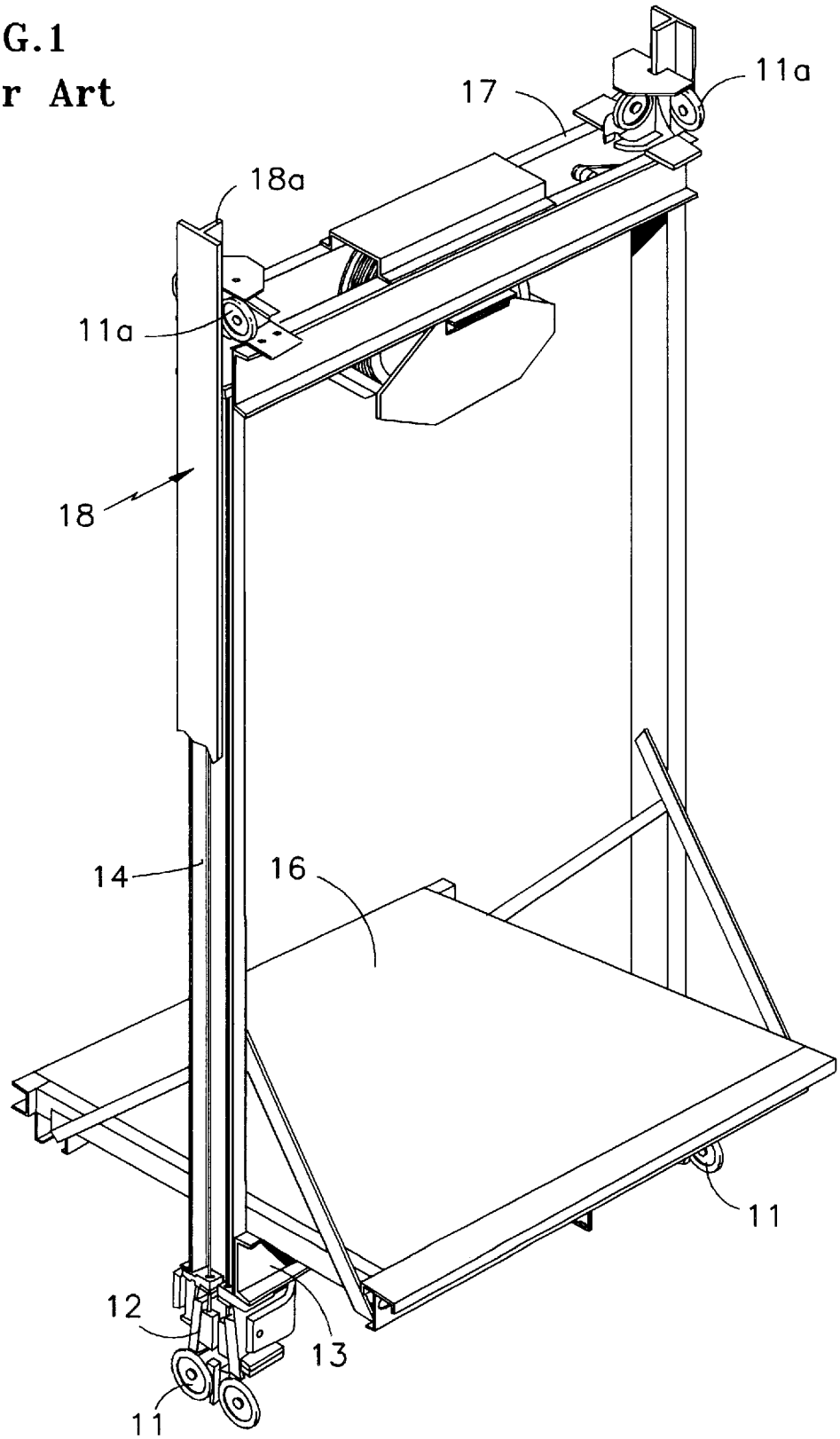
FIG.1 Prior Art
FIG. 1 is a perspective view of an elevator car frame, according to the prior art, showing roller guides and a safety, to which the present invention applies.

Referring now to FIG. 1, part of the frame of an elevator using an active roller guide is shown, the elevator having uprights 14 on which roller guides 11 and upper roller guides 11*a* are mounted, the roller guides having rollers on which the elevator can roll along T-rail 18. The roller guides 11 are positioned below safeties 12, which are activated by a governor (not shown) to slow the motion of the elevator in the event of unwanted elevator velocity. The safeties 12 are bolted to a safety plank 13, which supports a platform assembly 16. At the top of this partial frame there is a crosshead 17 leading from one side of the elevator to the other.

Figure 2:
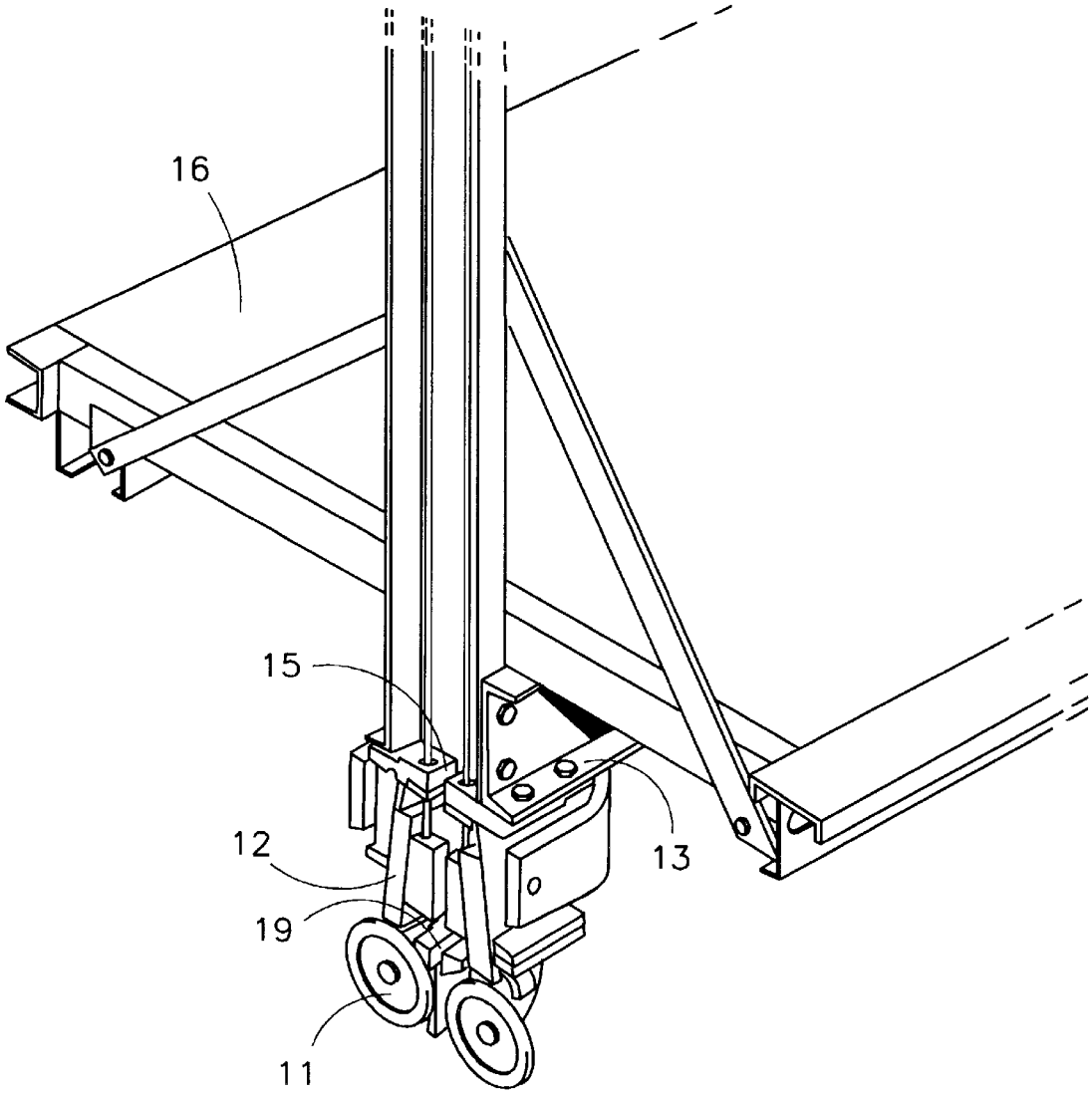
FIG.2 Prior Art
FIG. 2 is a close-up view of a safety and roller guide, according to the prior art, showing a safety throat and a roller guide throat.

In FIG. 2, there is shown in perspective a closer view of the roller guide 11 and safety 12 beneath the safety plank 13. In this view, both the roller guide throat 19 and safety throat 15 are visible. Both of these throats are simply notches in metallic plates designed to prevent the elevator car from swaying too far toward the T-rail nose 18*a* (FIG. 1). The safety throat 15 is smaller than the roller guide throat 19. When an elevator is installed at a site, each safety is bolted to the safety plank 13 so that the safety throat is centered with respect to the T-rail nose 18*a*. Next the roller guide 11 is loosely bolted to the safety 12, and adjusted so that the roller guide throat 19 is also centered with respect to the T-rail nose, or equivalently to the safety throat 15.

Figure 3:
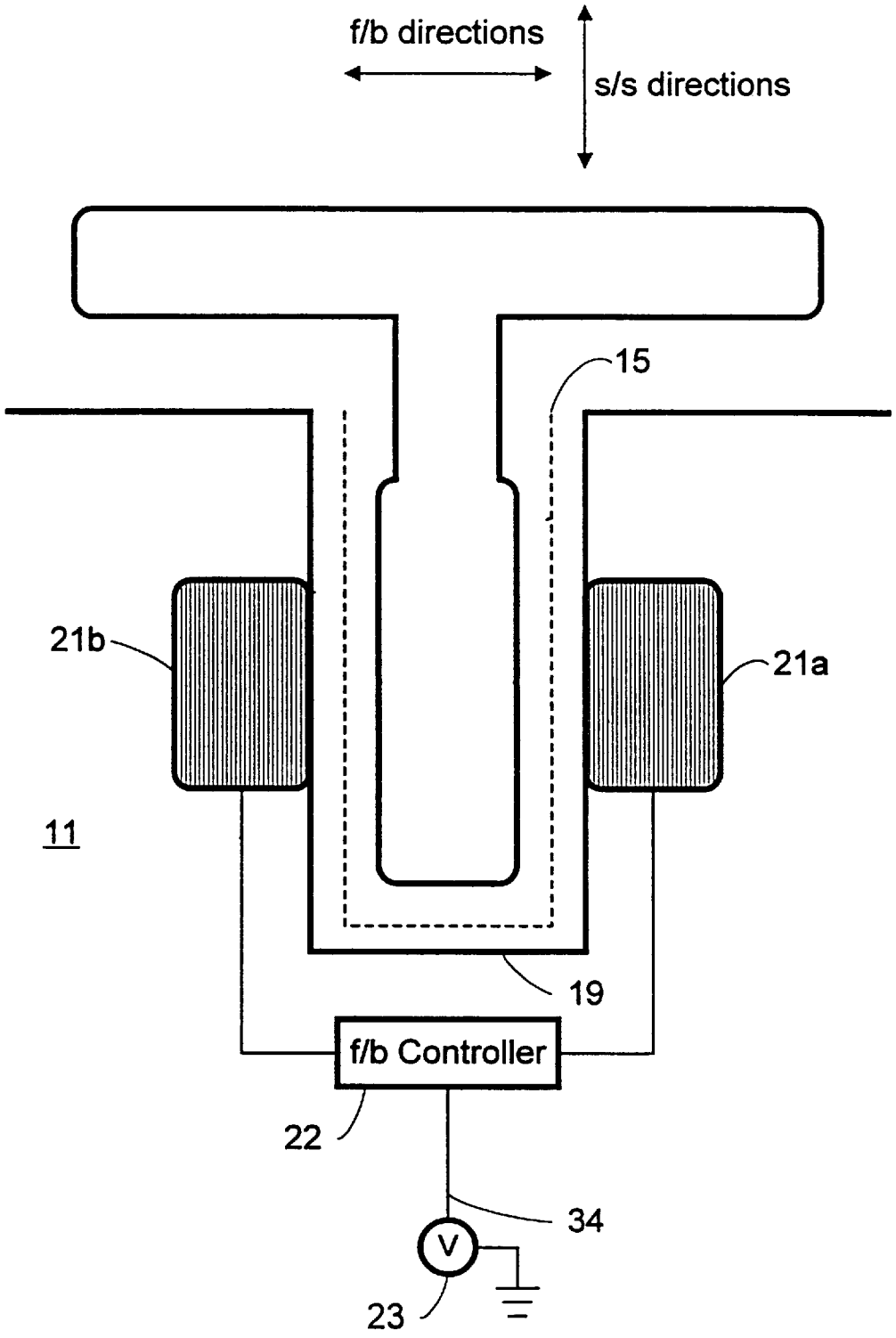
FIG. 3 is a schematic of a cross-section illustrating the geometry of aligning a roller guide with respect to the nose of a T-rail and, at the same time, to a safety throat.

Referring now to FIG. 3, according to the present invention the f/b controller 22 for a roller guide 11 is configured so that it will not produce commands to force actuators, but will provide a voltage reading indicating the distance between each position transducer 21*a* and 21*b* and the nose of the T-rail 18. These position transducers 21*a* and 21*b* are, in the case of both an active roller guide system and a semi-active roller guide system, the same transducers as are used in actual operation.

What is shown in FIG. 3 is a cross-section of the roller guide at the level of the roller guide throat 19, above the rollers. The front/back and side/side directions are also indicated. Finally, the safety throat 15 is shown as a dashed line because it lies in a plane different from that of the roller guide throat 19 (see FIG. 2).

The prior art often uses a special safety alignment fixture mounted on the nose of the T-rail to position the safety so that the safety throat 15 is centered, in a front-to-back sense, about the nose of the T-rail. Then the roller guide to be attached to that safety is loosely bolted to the safety, and, using the method of the present invention, manually adjusted according to direction from the voltmeter 23, which indicates zero potential, or some other reference potential, when the roller guide throat 19 is centered with respect to the T-rail, and so also centered, in a front-to-back sense, with respect to safety throat 15.

Figure 4:
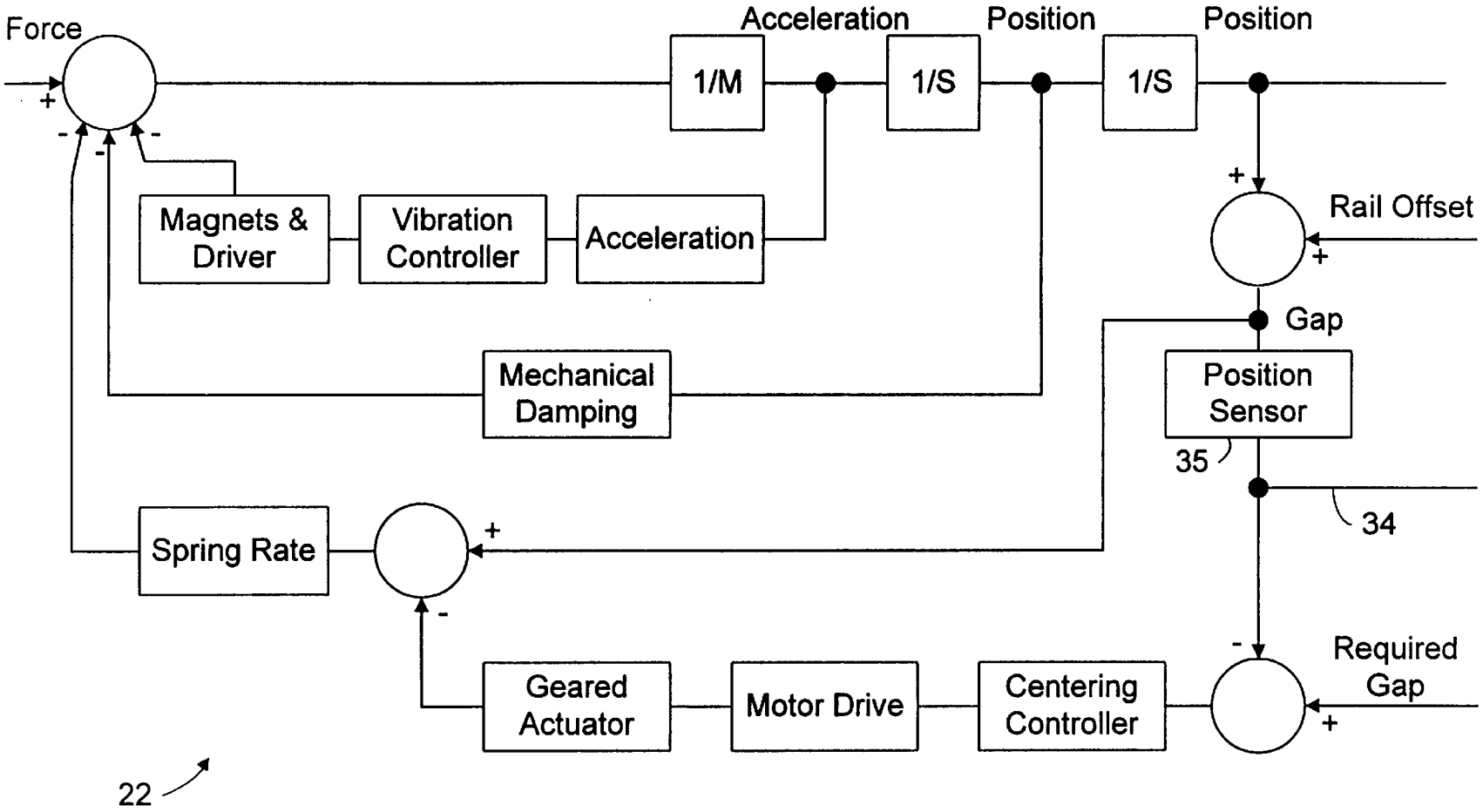
FIG. 4 is a block diagram of a f/b controller showing where output is derived during the installation according to the present invention.

FIG. 4 is a block diagram of a typical f/b controller for an active roller guide system. According to the present invention, during installation, this f/b controller is configured to prevent sending commands to force actuators.

However, the position sensor 35 is enabled. Thus the position sensor 35 can produce an output, shown provided on lead 34, that indicates whether the roller guide is centered and what direction to move the roller guide to improve centering. The output on lead 34 is typically a voltage relative to ground, but may be signals based on other physical conditions.

Figure 5:
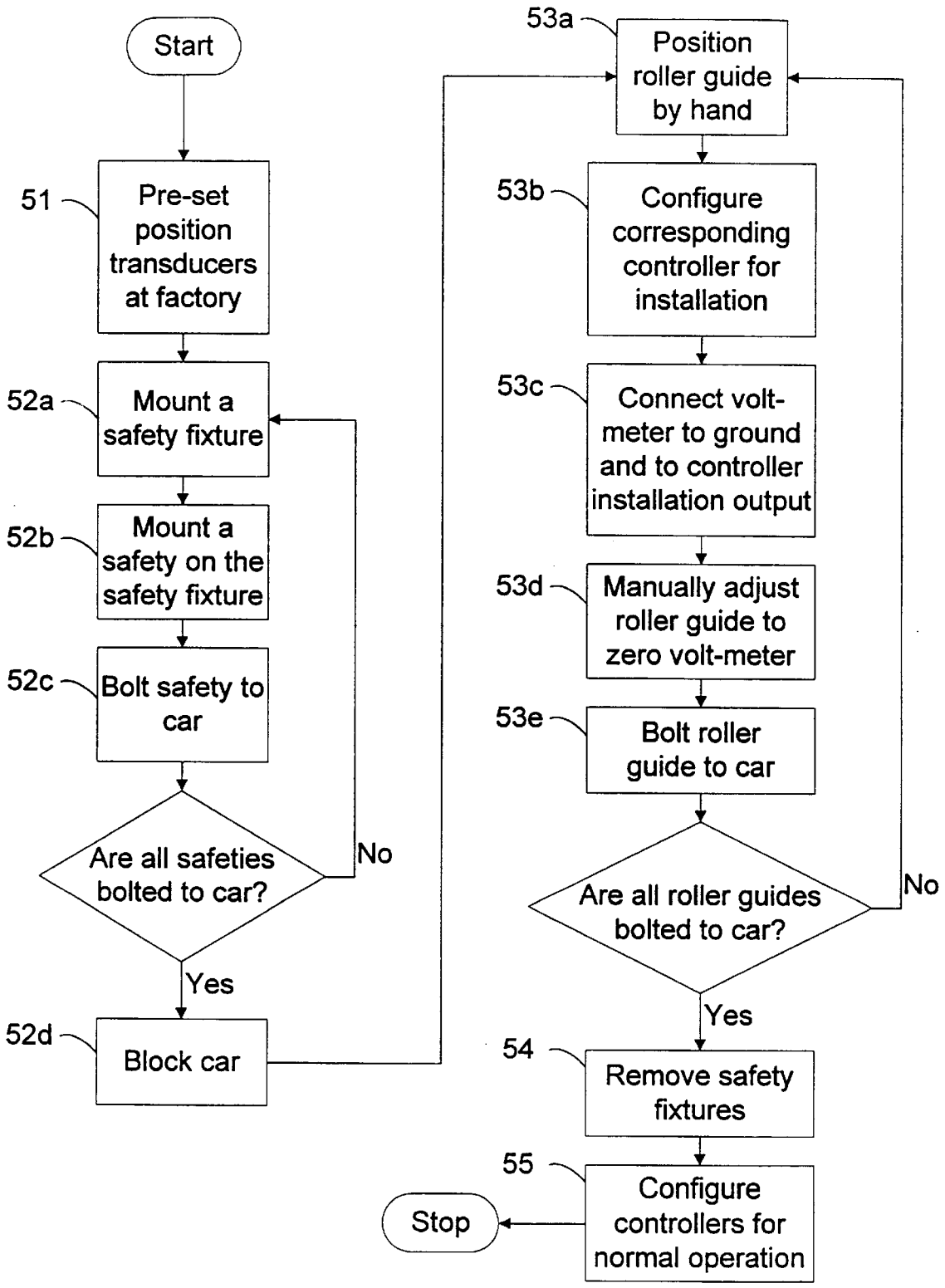
FIG. 5 is a process flow diagram illustrating the method of aligning the roller guides of an elevator according to the present invention.

FIG. 5 presents a process flow chart of the method of aligning roller guides according to the present invention. First, at block 51, the position transducers for each roller guide are preset at the factory so as to each produce the same potential when the rollers are the same distance from the nose of a T-rail. Then, at block 52*a*, in the field, a special safety alignment fixture is mounted over the nose of each T-rail. In block 52*b*, a safety is mounted on each safety alignment fixture, the alignment fixture designed so that the safety, when it is mounted on the alignment fixture, is centered, in a front-to-back sense with respect to the T-rail nose 18*a* (see FIG. 1). With the safety centered, in block 52*c*, it is bolted to the elevator car safety plank 13. When both safeties have been bolted to the car, in block 52*d*, the car is blocked so that it is held fixed in position on the T-rails. The blocking should be done so that the car platform assembly 16 is level, which will likely result in the safeties not being tilted at some angle with respect to the T-rails.

Then, in the next several steps, each roller guide in turn is mounted on the safety so that it ends up centered. The first step 53*a* is to loosely bolt a roller guide to its safety and approximately center it. This step is done by hand without using output from the position transducers. Then, in block 53*b*, the corresponding f/b controller is configured for installation. This amounts to disabling the f/b controller except for its providing a voltage, at lead 34, that indicates a reference value only when the roller guide throat is centered, in a front-to-back sense, on the T-rail nose 18*a*. In block 53*c*, a voltmeter is then attached to the output lead 34 and to ground. In other embodiments, any common reference may be used for measuring the signal on output lead 34. Next, in block 53*d*, the roller guide is manually repositioned to cause the voltmeter to indicate the reference voltage that was preset at the factory. In the preferred embodiment, this reference voltage is zero, and when the voltmeter displays a positive or negative voltage, it indicates that the roller guide is too far in one direction or the other.

After centering each roller guide according to the indication by the voltmeter, in block 53*e*, the roller guide is bolted to the safety. When both roller guides have been bolted to their safeties, in block 54, the safety alignment fixtures are removed, and, in block 55, the f/b controllers are configured for normal operation.

The method according to the present invention can be used even in an elevator using a passive roller guide system. Such a system does not have position transducers in normal operation. Yet these systems are not mechanically dense, so it is not difficult to attach position transducers during installation, subtract their outputs in a differential position sensor, position the several hundred-pound roller guides on their respective T-rails, and then remove the position transducers and differential sensor.

In particular, the method of the present invention can be used to center the upper roller guides 11*a* (see FIG. 1), although the full installation procedure for the safety adjacent roller guides is changed so that these upper roller guides are bolted to an element of the crosshead 17. These upper roller guides 11*a* may not be part of an active or semi-active roller guide system, so there may not be associated transducers. Then, according to the present invention, one or more transducers and a means for processing the signal from each transducer may be temporarily interfaced with the upper roller guides to aid in their precise centering with respect to the nose of the T-rail.

As is well known in the art, there are many ways in which transducers are used as part of an active or semi-active roller guide system. In some systems, only a single transducer is used, with its output correlated to the position of the roller guide relative to the nose of the T-rail. The present invention is in no way limited to roller guide systems consisting of two transducers mounted on opposing sides of the roller guide throat. Any transducer arrangement can be accommodated by the method of the present invention because the present invention relies on determination of a reference signal, indicating centering, and, optionally, a calibration of other output signals indicating distance and direction of the roller guide from center.

It is to be understood that the above described arrangements are only illustrative of the application of the principles of the present invention. Numerous modifications and alternative arrangements may be devised by those skilled in the art without departing from the spirit and scope of the present invention, and appended claims are intended to cover such modifications and arrangements.

What is claimed is:

1. A method for centering an elevator roller guide on a T-rail, in a front-to-back sense, the T-rail having a nose that protrudes in normal operation into a throat of the roller guide and between rollers of the roller guide, the T-rail extending on either side of a hoistway along which the elevator moves, the centering to result in the T-rail nose positioned midway between opposing sides of the roller guide throat, the method comprising the step of processing signals from one or more position transducers, each affixed to the roller guide and oriented so as to sense the nose of the T-rail when the roller guide is positioned on the T-rail for normal operation, the processing of each signal performed to indicate, by comparison with a predetermined reference signal, whether the roller guide is centered on the T-rail nose, and to indicate in which direction to move the roller guide to more accurately center it with respect to the nose of the T-rail.

2. A method for centering an elevator roller guide on a T-rail, in a front-to-back sense, as claimed in claim 1, wherein the processed transducer signals are calibrated to indicate not only in what direction, but also approximately how far to move the roller guide to center it.

3. A method for centering an elevator roller guide on a T-rail, in a front-to-back sense, as claimed in claim 1, further comprising the steps of first centering a safety on the T-rail nose, bolting the safety to the elevator car, and loosely bolting the roller guide to the safety.

4. A method for centering an elevator roller guide on a T-rail, in a front-to-back sense, as claimed in claim 1, wherein, in the case of an elevator having a roller guide system including a front-to-back controller that controls the position of the elevator with respect to a T-rail nose, the one or more position transducers are those that are part of the roller guide system, and the position sensor is part of the front-to-back controller.

* * * * *